US011358770B2

(12) United States Patent
Davis

(10) Patent No.: US 11,358,770 B2
(45) Date of Patent: Jun. 14, 2022

(54) CONTACT LENS BLISTER PACK LABEL AND METHOD FOR ADJOINING BLISTER PACKS

(71) Applicant: CooperVision International Limited, Fareham (GB)

(72) Inventor: Robert Davis, Eastleigh (GB)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 389 days.

(21) Appl. No.: 16/076,330

(22) PCT Filed: Feb. 27, 2017

(86) PCT No.: PCT/GB2017/050525

§ 371 (c)(1),
(2) Date: Aug. 8, 2018

(87) PCT Pub. No.: WO2017/149283

PCT Pub. Date: Sep. 8, 2017

(65) Prior Publication Data

US 2019/0039798 A1 Feb. 7, 2019

Related U.S. Application Data

(60) Provisional application No. 62/301,123, filed on Feb. 29, 2016.

(51) Int. Cl.
*B65D 75/32* (2006.01)
*B65B 25/00* (2006.01)
(Continued)

(52) U.S. Cl.
CPC ..... *B65D 75/326* (2013.01); *B65B 13/00* (2013.01); *B65B 25/008* (2013.01); *B65B 61/12* (2013.01);
(Continued)

(58) Field of Classification Search
CPC ..... B65D 75/326; B65D 71/0085; B65D 71/508; B65D 63/1009; B65D 2585/545;
(Continued)

(56) References Cited

U.S. PATENT DOCUMENTS 4,691,820 A * 9/1987 Martinez ..... B65D 75/326 206/205
5,620,088 A * 4/1997 Martin ..... B65B 25/008 206/5.1
(Continued)

FOREIGN PATENT DOCUMENTS

CH 686127 A5 1/1996
CN 101316702 A 12/2008
(Continued)

OTHER PUBLICATIONS

Office Action received in corresponding Korean Patent Application No. 10-2018-7027537 dated Dec. 10, 2018 with English translation (7 pages).
(Continued)

*Primary Examiner* — Anthony D Stashick
*Assistant Examiner* — James M Van Buskirk
(74) *Attorney, Agent, or Firm* — Kilyk & Bowersox, P.L.L.C.

(57) ABSTRACT

Contact lens packaging (2) includes two or more individual, sealed blister packs (1) coupled together by a connecting label (5), which includes a uni-axial shear polymer film (6). The connecting label (5) is arranged and oriented such that the tear direction of the polymer film (6) is parallel to a line (A) bisecting adjacent blister packs (1). Methods of binding together two or more blister packs (1) are also described.

20 Claims, 3 Drawing Sheets

(51) Int. Cl.

| | |
|---|---|
| ***B65D 71/00*** | (2006.01) |
| ***B65B 61/12*** | (2006.01) |
| ***B65D 71/50*** | (2006.01) |
| ***B65D 63/10*** | (2006.01) |
| ***B65B 13/00*** | (2006.01) |

(52) U.S. Cl.
CPC ..... *B65D 63/1009* (2013.01); *B65D 71/0085* (2013.01); *B65D 71/508* (2013.01); *B65D 2585/545* (2013.01)

(58) Field of Classification Search
CPC ..... B65D 25/00; B65D 75/32; B65D 81/22; B65D 75/002; B65D 75/009; B65D 75/006; B65B 13/00; B65B 61/12; B65B 25/008; B64D 71/08; B32B 7/06; B32B 2519/00; B32B 2307/75; B42D 15/006; G09F 3/0288; G09F 2003/023; G09F 2003/0269; G09F 2003/0267; G09F 2003/022; G09F 2003/0257; Y10T 156/1082; Y10T 428/1495; Y10T 156/108
USPC ..... 206/5.1, 497, 432, 345; 156/249, 267, 156/288; 498/42.3
See application file for complete search history.

(56) References Cited

U.S. PATENT DOCUMENTS

| | | | | |
|---|---|---|---|---|
| 6,244,442 | B1 * | 6/2001 | Inoue | A61J 1/035 206/469 |
| 8,056,716 | B2 * | 11/2011 | Fonteyne | B32B 7/05 206/365 |
| 9,585,450 | B2 * | 3/2017 | Peck | A45C 11/046 |
| 10,390,593 | B2 * | 8/2019 | English | B65B 55/22 |
| 10,668,267 | B2 * | 6/2020 | Tennican | B65D 71/0085 |
| 2006/0201103 | A1 * | 9/2006 | Tokarski | B65D 75/323 52/750 |
| 2008/0251411 | A1 | 10/2008 | Walker et al. | |
| 2009/0050664 | A1 * | 2/2009 | Henza | F16B 43/00 227/16 |
| 2014/0284229 | A1 * | 9/2014 | Newman | A45C 11/046 206/213.1 |
| 2017/0209613 | A1 * | 7/2017 | Westphal | A01M 29/12 |
| 2017/0223879 | A1 * | 8/2017 | Mitchell | B65D 85/80 |
| 2018/0029770 | A1 * | 2/2018 | Nabeiro | A47J 31/4492 |

FOREIGN PATENT DOCUMENTS

| | | | |
|---|---|---|---|
| EP | 1491458 | A2 | 12/2004 |
| GB | 2492997 | A | 1/2013 |
| JP | H07256842 | A | 10/1995 |
| JP | H1086969 | A | 4/1998 |
| WO | 9964531 | A1 | 12/1999 |
| WO | 2013160667 | A1 | 10/2013 |
| WO | 2014185354 | A1 | 11/2014 |

OTHER PUBLICATIONS

International Search Report and Written Opinion issued in corresponding International Patent Application No. PCT/GB2017/050525 dated Apr. 19, 2017 (12 pages).
Demand filed Sep. 25, 2017 in corresponding International Patent Application No. PCT/GB2017/050525 (15 pages).
Written Opinion of the International Preliminary Examining Authority issued in corresponding International Patent Application No. PCT/GB2017/050525 dated Feb. 26, 2018 (6 pages).
Response to Written Opinion of the International Preliminary Examining Authority filed Apr. 19, 2018 in corresponding International Patent Application No. PCT/GB2017/050525 (13 pages).
International Preliminary Report On Patentability issued in corresponding International Patent Application No. PCT/GB2017/050525 dated May 17, 2018 (19 pages).
Office Action received in corresponding Chinese Patent Application No. 201780014146.3 dated Nov. 29, 2019 (with English translation) (13 pages).

* cited by examiner

CONTACT LENS BLISTER PACK LABEL AND METHOD FOR ADJOINING BLISTER PACKS

This application is a National Stage Application of PCT/GB2017/050525, filed Feb. 27, 2017, which claims the benefit under 35 U.S.C. § 119(e) of prior U.S. Provisional Patent Application No. 62/301,123, filed Feb. 29, 2016.

The present invention relates to blister pack packaging for contact lenses, and particularly to a blister pack label and related methods for adjoining separate, sealed blisters packages.

BACKGROUND

Disposable contact lenses are traditionally packaged in blister packs, with each pack including a plastic, e.g. polypropylene, base member housing a single contact lens and storage solution in a cavity, topped by a film of sealing material, typically a multi-layer film comprising a foil layer. Off-the-shelf contact lenses that are produced in high volumes are typically packaged in strips of blisters, with at least two, and often three or more blister packs lying adjacent along a strip. Multiple blisters are traditionally connected together in such a strip through conjoined base members, or due to a single sealing member extending across multiple base members. Individual sealed blisters are separated from the strip, for example, by breaking apart the base members and/or by tearing the sealing member at the intersection between adjacent blisters. The base member and/or the multilayer film that tops the strip may incorporate perforations along lines bisecting adjacent blisters, facilitating the separation of an individual blister whilst leaving the remaining sealed blisters intact.

The method of packaging described above can be inconvenient for packaging custom or low volume contact lenses, such as made-to-order contact lenses that have relatively low to medium production levels. In previous practice, strips of blisters were used to package contact lenses of the same parameters (e.g., same material and same design), and the manufacturing packaging line was only set up to package lenses in strips of blisters. If a consumer required a single, made-to-order contact lens, the lens would be packaged in one of the blisters situated along the strip. The remaining blisters on the strip would remain empty and would later be discarded. This method of packaging can result in significant quantities of waste when used for single made-to-order lenses.

In order to reduce the amount of waste, packaging lines can be configured to produce made-to-order contact lenses packaged in individual, sealed blister packs that comprise a single lens. If a consumer requires a single contact lens they will receive one sealed blister pack housing the single lens, and if the consumer requires multiple contact lenses they will receive, multiple, individual blister packs each housing a single lens. This practice eliminates the waste packaging caused by empty blisters. However, secondary packaging for contact lenses is generally designed to accommodate strips of blisters, and consumers and stockists are familiar with receiving multiple contact lenses in strips of conjoined blister packs.

The present inventors have identified a need for a packaging for contact lenses that enables both individual blisters and strips of multiple connected blisters to be produced from a single packaging line without the need to reconfigure the packaging line or without the need to discard empty blisters.

SUMMARY OF THE INVENTION

The present invention provides a packaging system that meets these requirements through the use of a blister pack label. In particular, in a first aspect, the present invention provides packaging for contact lenses comprising at least two individual, sealed blister packs and a connecting label, each of the at least two blister packs including a plastic base member housing a single contact lens, and a sealing member; wherein the connecting label is adhered to the sealing members of each of the at least two blister packs to bind the blister packs together; and wherein the label comprises a polymer film, in particular a uni-axial shear polymer film, for example a machine directed oriented (MDO) film, the label being arranged and oriented such that the tear direction of the polymer film lies parallel to a line bisecting adjacent blister packs. In a second aspect, the invention provides a method of binding together at least two contact lens blister packs, each of the at least two blister packs comprising a plastic base member housing a single contact lens, and a sealing member; the method comprising a step of orientating a connecting label comprising a uni-axial shear polymer film, such that the tear direction of the label lies parallel to a line connecting adjacent blister packs; and applying the label to the sealing members of two or more adjacent blister packs, to bind the blister packs together.

In the event that a lens wearer requires multiple made-to-order contact lenses, it is desirable for the lenses to be provided in strips of blister packs to facilitate secondary packaging and to meet expectations of lens wearers and lens stockists, e.g. inventory personnel. It is also desirable for lens wearers to be able to tear individual blisters from strips of multiple blisters, leaving the remaining blisters intact, i.e. without compromising the seal of the remaining blisters. The present invention advantageously provides a packaging that meets these requirements through the use of a blister pack label. It has been found that on separating single blister packs from an adjacent blister pack provided in strips of multiple blister packs of the packaging of the invention, there is a low incidence of the sealing member of the adjacent blisters being damaged.

DETAILED DESCRIPTION

Figure 1:
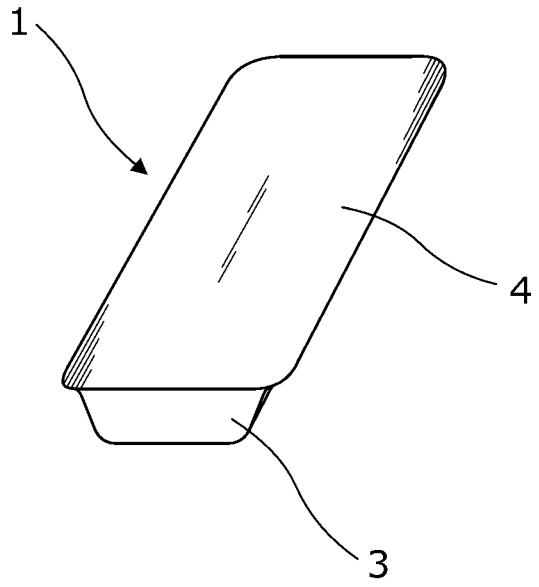
FIG. 1 shows an individual blister pack.

In a first aspect, the present invention provides packaging for contact lenses comprising at least two individual, sealed blister packs and a connecting label, each of the at least two blister packs including a plastic base member housing a single contact lens, and a sealing member; wherein the connecting label is adhered to the sealing members of each of the at least two blister packs to bind the blister packs together; and wherein the label comprises a polymer film, in particular a uni-axial shear polymer film for example, a machine direction oriented (MDO) polymer film, the label being arranged and oriented such that the tear direction of the polymer film lies parallel to a line bisecting adjacent blister packs. In a second aspect, the invention provides a method of binding together at least two contact lens blister packs, each of the at least two blister packs comprising a plastic base member housing a single contact lens, and a sealing member; the method comprising a step of orientating a connecting label comprising a machine direction oriented or uni-axial shear polymer film, such that the tear direction of the label lies parallel to a line connecting adjacent blister packs; and applying the label to the sealing members of two or more adjacent blister packs, to bind the blister packs together. The method of the second aspect of the invention may, for example be a method of producing the packaging of the first aspect of the invention.

In accordance with the disclosure herein, it can be understood that preferably each of the sealed blister packs is otherwise not connected to another sealed blister pack but for the connection provided by the connecting label. Thus, the connecting label is a device that couples two or more individual sealed blister packs together, and is the only coupling mechanism among the blister packs.

In addition, while the illustrated embodiments of the present blister packs are depicted as having a plastic base member having a cavity dimensioned to accommodate a contact lens and a packing solution, a flange region surrounding the cavity, and a sealing member coupled to the flange region, other embodiments of the blister packs can have a sealed cavity provided between two flexible substrates, wherein the cavity does not exist in either of the flexible substrates alone.

The connecting label included in the packaging of the first aspect of the invention and used in the method of the second aspect of the invention is optionally a multilayer, e.g. laminate material, comprising more than one layer, at least one of which is a polymer film. In addition to the polymer film the connecting label may comprise one or more of an adhesive layer, a printed and/or printable surface layer.

The connecting label included in the packaging of the first aspect of the invention and used in the method of the second aspect of the invention comprises a polymer film. The polymer film is manufactured such that it tears most readily in one dimension. Materials that have that property are termed "uni-axial shear" materials reflecting their propensity to tear along a single axis. Polymer films having that property, i.e. which tear readily in a single dimension, include machine direction orientated (MDO) films. It is known that orientation of polymer films can be used to enhance and alter their properties, particularly mechanical properties. MDO films are typically produced by drawing (stretching) a polymer film after a web of polymer has been produced, to uni-axially orientate the film in the machine direction of the web. Polymer films are typically produced using either cast or blowing processes or by extrusion. Through the machine direction orientation process, the polymer film is uni-axially oriented in the machine direction of the web. Stretching in the machine direction is typically achieved by passing the web of polymer film through a series of rolls with gradually increasing speed. These rolls may be heated in order to raise the temperature of the film. After the polymer film is stretched in the machine direction, the polymer film may be rapidly cooled to set the orientation of the film. The crystallinity of semi-crystalline polymer plastics, such as polypropylene (PP) is generally augmented by the stretching process. The orientation process leads to reduction of the tear resistance along the machine direction, such that MDO films shear in the direction of travel in which the film was drawn. Labels made from MDO polymer films with uni-axial shear tear properties are well known in the labelling field and are described, for example, in WO 2010/103191 A1, the disclosure of which is incorporated herein by reference.

The polymer film of the connecting label may, for example, be cast, blown or extruded and then machine orientated. Advantageously the polymer film is a film of extruded polymer material. Orientation may take place in a stage of the extrusion process, for example, by stretching the extruded polymer before it is cooled. The machine direction oriented polymer may be a monolayer or a multilayer film. A multilayer film may, for example, be a co-extruded film prepared by a co-extrusion process. Alternatively the multilayer film may, for example, be produced by a lamination or coating process. The polymer film is optionally a corona treated film. The polymer film is advantageously thermoplastic. Thermoplastic films are typically responsive to machine direction orientation.

The polymer film may comprise a single polymer or copolymer or a blend of different polymers and/or copolymers. The polymer film is optionally, or optionally comprises, a polyolefin. The polymer film may be a homopolymer or a copolymer formed from one or more olefins. Homopolymers are formed from a single type of monomer. Copolymers may be random copolymers formed from a random polymerization of a mixture of two or more monomers or block copolymers comprising blocks, e.g. alternating blocks, of two or more different polymers. Typically the polymer film comprises a polymer formed from $C_2$ to $C_6$ alkylene monomers, such as ethylene, butane and propylene, and co-polymers thereof. The polymer film may, optionally, comprise a polypropylene (PP), for example a PP homopolymer consisting only of propylene-derived units or a copolymer of propylene and co-monomer, such as ethylene and/or butylene. The polymer film may optionally comprise a polyethylene (PE). The PE may be low density polyethylene (LDPE), which has relatively long branches off the polymer chain; linear low density polyethylene (LLDPE), which has extensive relatively short branches off the polymer chain; or high density polyethylene (HDPE), which has little branching. Optionally the polymer film comprises LLDPE. LLDPE has been found to be particularly suitable due to its strength, stiffness and anti-tear properties, LLDPE being found to resist tearing in direction other than machine direction. The polymer film optionally is or comprises a copolymer comprising styrene, such as a block copolymer of styrene and $C_2$ to $C_6$ alkylene monomer, for example, styrene-ethylene/propylene-styrene block copolymer (SEPS), styrene-ethylene/butylene-styrene block copolymer (SEBS), styrene-ethylene/propylene block copolymer (SEP) or styrene-ethylene-ethylene/propylene-styrene block copolymer (SEEPS). The polymer film may, for example, comprise from 1 to 30 wt %, such as from 2 to 20 wt %, styrene copolymers. Suitable commercially-available polymers for use in forming the MDO films of the invention are listed in table 3 of WO 2010/103191 A1 (pages 12 and 13), the disclosure of which is incorporated herein by reference. The polymer film optionally comprises hydrocarbon resins. In addition to polymers, the polymer film typically comprises one or more additives, for example, at a level of from 1 to 20 wt %, such as from 2 to 15 wt %. Suitable additives include fillers and colorants, for example, white pigments to provide the polymer film with an opaque white appearance. Advantageously, the machine direction oriented polymer film of the connecting label is a multilayer film of co-extruded polymer material, for example, a corona-treated multilayer film of co-extruded polyolefin material. Examples of suitable commercially available MDO polymer films are the Fasson Global Co-Ex range of films available from Avery Dennison of Mentor, Ohio, USA.

One surface of the connecting label optionally bears a printed image. The printed image advantageously provides information concerning the contact lenses contained within the blister packs, for example the brand and manufacturer. The printed image may, for example, be imparted to the polymer film of the connecting label by flexo, screen, offset or letter press printing, especially UV-curable printing. A surface of the connecting label may, optionally, be printable, for example, by ink jet printing. A surface of the connecting label may, for example, be rendered printable by corona treatment, by the use of a coating, or due to the presence of a printable skin layer in a multi-layer film. The printable surface may, for example, be formed of a polyethylene (PE), such as LLDPE. In one embodiment, the polymer film is a multilayer film comprising a surface layer of PE, which PE layer provides a printable surface. Including a printable surface in the connecting label, may, for example, facilitate the addition of information concerning the lenses contained within the blister packs after or shortly before the packaging has been sealed, for example information about the optical power of the contact lenses contained in each blister pack may be added after or just before the label has been applied to the sealed blister packs.

The connecting label may, optionally, comprise an adhesive layer. The connecting label is optionally adhered to the surface members of the blisters with an adhesive. The step of applying the label to the sealing members of the blister packs of the method of the second aspect of the invention may, for example, include the step of adhering the label to the sealing members, e.g. using an adhesive. The adhesive may be applied to the machine directed oriented polymer film after the film has been prepared or may be applied during manufacture of the film, for example, when the film is formed. In one embodiment of the invention, the adhesive may be applied onto a surface of the film by a coating station, for example, by a roller-coater or spray-coater, after the film has been prepared, e.g. after extrusion of an extruded polymer film. In another embodiment of the invention, the film may be prepared with an adhesive layer, for example, by a co-extrusion process in which the machine directed oriented polymer film and adhesive are extruded simultaneously. The connecting label may be self-adhesive. For example, the connecting label may be a pressure sensitive adhesive labelling (PSA labelling) or self-stick adhesive labelling, in which the adhesive forms a bond when pressure is applied on the label, adhering the adhesive label with the sealing members. The adhesive is optionally an acrylic based adhesive.

The connecting label may, optionally, comprise an opaque layer. The opaque layer may be the polymer film or an additional layer. For example, the polymer film may comprise additives that renders the polymer film opaque. Additionally or alternatively the connecting label may be a multilayer laminate comprising an opaque layer, such as a paper layer.

The blister packs for contact lenses typically have a substantially planar surface. The sealing members of the blister packs typically define at least a part of the substantially planar surface of the blister packs. The blister packs are typically configured such that the substantially planar surface is the upper surface in normal use. As mentioned above, the plastic base member of the blister packs typically comprises a well or cavity into which the contact lens, and optionally a storage or packaging solution, is housed. The blister packs are typically configured such that, in use, at least a part of a sealing member of the blister pack is removed providing access to the contact lens housed within the plastic base member. An arrangement whereby part of a sealing member defines at least a part of the upper surface may enable the lens, and optional storage solution, to be retained in the plastic base member, e.g. in a well, once the blister pack has been opened. The individual blister packs in the packaging of the first aspect of the invention and used in the method of second aspect of the invention advantageously include a substantially planar surface, such as a substantially planar upper surface, formed at least in part by the sealing members of the blister packs. The connecting label is advantageously applied across the substantially planar surface of more than one blister pack, especially across substantially planar surfaces formed at least in part by the sealing members of more than one blister pack.

In the packaging of the invention, the connecting label advantageously extends across at least two blister packs, e.g. across three or more blister packs. As contact lenses are conventionally packaged in strips of three connected blister packs, in the packaging of the first aspect of the invention the connecting label typically binds three blister packs together. Similarly, in the method of the second aspect of the invention, the connecting label is typically applied across the sealing members of three blister packs to bind them together. However, it will be appreciated that the invention can be used to bind together other numbers of blister packs, such as two blister packs or four or more blister packs. Typically, contact lens blister packs are of the order to 25 to 40 mm wide. In order to extend across and so bind together three contact lens blisters arranged side by side, the connecting label advantageously has a longest dimension of at least twice the width of the blister packs. For example, the connecting label may have a longest dimension of at least about 50 mm, especially at least about 70 mm, for example a longest dimension of from about 60 to about 120 mm, especially from about 80 to about 100 mm, such as from 85 to 95 mm.

The sealing members are typically a multi-layer film, optionally comprising a metallic foil layer.

Figure 2:
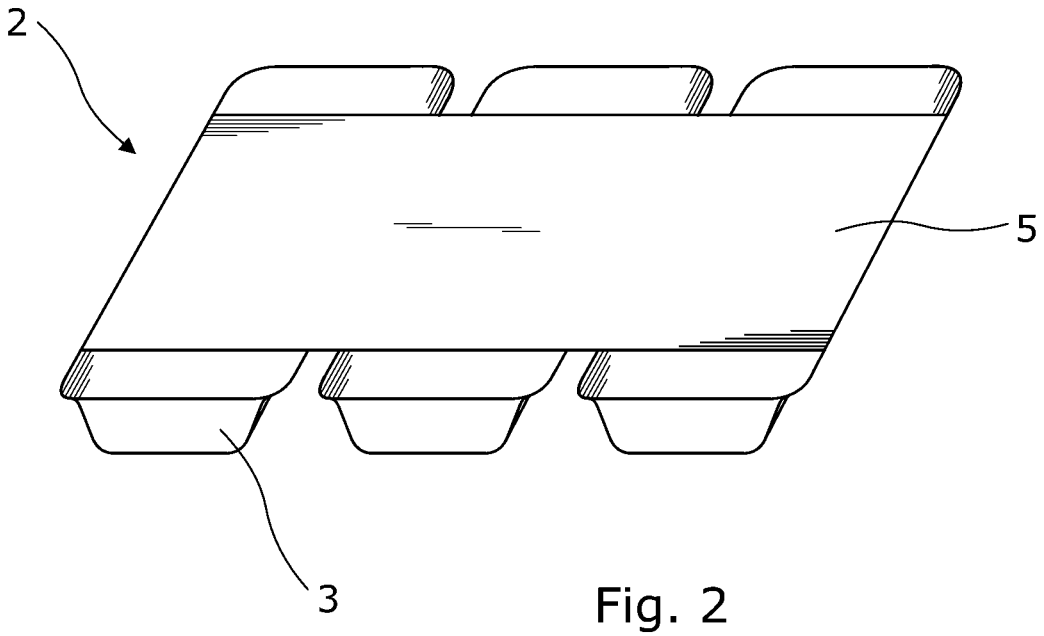
FIG. 2 shows a perspective view of a packaging according to an embodiment of the invention comprising a strip of conjoined blister packs.
Figure 4:
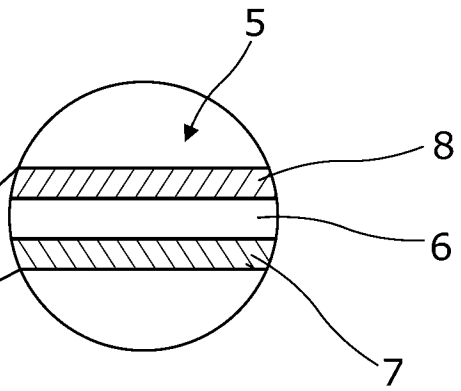
FIG. 4 shows a close up of part of the packaging of FIG. 3 showing the layers present in a connecting label.
Figure 3:
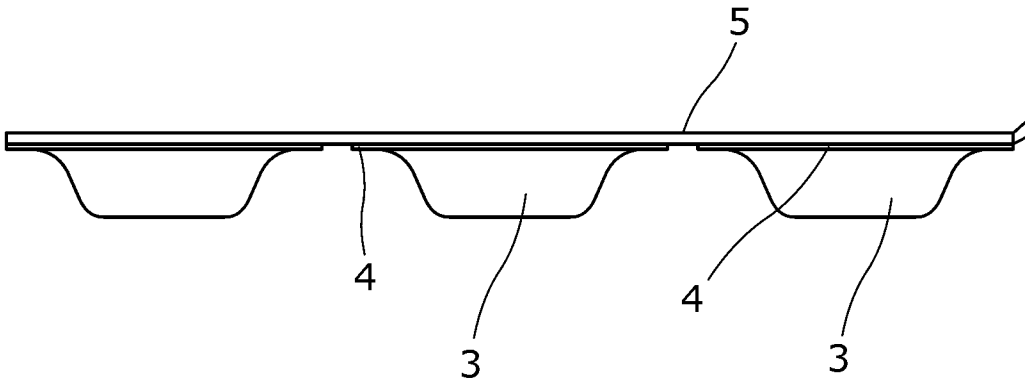
FIG. 3 shows a side view of a packaging according to an embodiment of the invention.
Figure 5:
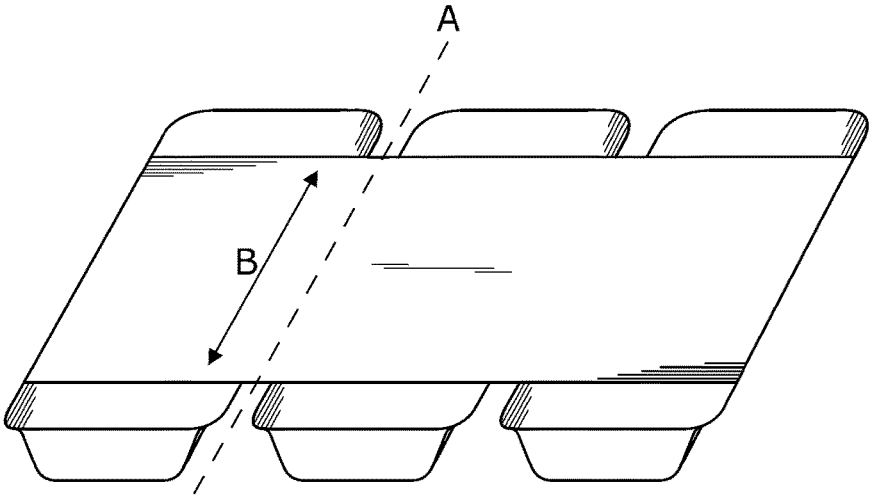
FIG. 5 shows a perspective view of a packaging according to an embodiment of the invention comprising a strip of conjoined blister packs.
Figure 6:
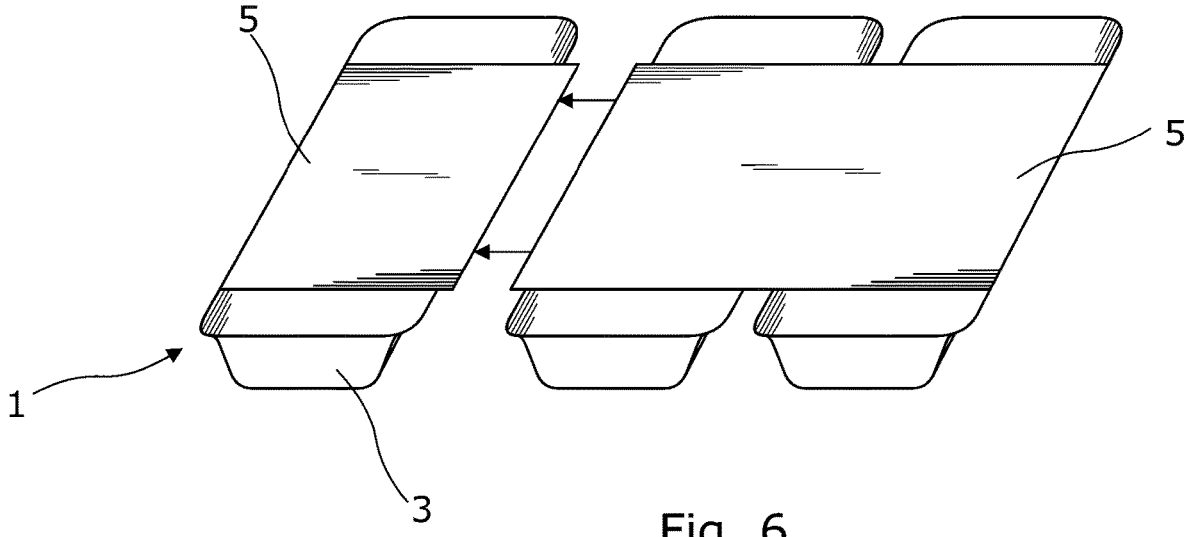
FIG. 6 shows a perspective view of a packaging according to an embodiment of the invention following removal of an individual blister pack from a strip.

The invention will now be described with respect to the illustrative non-limiting example embodiments. FIG. 1 shows an individual sealed blister pack 1, which can be used in one embodiment of the invention. The individual blister pack 1 comprises a plastic base member 3 that houses a contact lens (not shown) together with a packing solution (not shown). The blister pack 1 comprises a sealing member 4 that extends across the base member 3 and which forms a substantially planar upper surface. FIG. 2 shows an embodiment of a packaging 2 for contact lenses of the invention. The packaging 2 comprises three individual blister packs 1 that each include a plastic base member 3 housing a single contact lens (not shown), and a sealing member 4. The packaging 2 comprises a connecting label 5 that binds together three individual blister packs 1 into a strip. In the event that a consumer requires multiple made-to-order contact lenses, individual blister packs 1 are adjoined to form the strip as shown in FIG. 2 in accordance with the method of the invention. The label 5 is adhered to the sealing members 4 of at least two blister packs 1 to bind the blister packs together. As shown in FIG. 3, the connecting label 5 spans between the sealing members 4 of adjacent blister packs. As shown in FIG. 4, the label comprises a polymer film 6 formed of a multilayer, laminate material comprising an adhesive layer 7, a printed and or/printable surface layer 8 and a core layer 6 formed of a polymer film. The polymer film of the core layer 6 is a uni-axial shear film, for example a machine direction oriented (MDO) film. As shown in FIG. 5, the label is arranged such that a line A bisecting adjacent blister packs 1 lies parallel to the tear direction of the polymer film of the core layer 6 which is indicated by arrow B. In use, the connecting label 5 may be torn along the line A to remove an individual blister 1 from the strips of blisters of the packaging 2 of the invention. As shown in FIG. 6, the individual blister is thereby separated from the strip leaving the remaining blisters intact and without comprising the seal formed between the sealing member 3 and the plastic base member 3 of any of the blister packs 1.

The invention claimed is:

1. Packaging for contact lenses comprising at least two individual, sealed blister packs and a connecting label comprising a polymer film, each of the at least two individual, sealed blister packs including a plastic base member housing a single contact lens and packaging solution, and a sealing member; wherein the connecting label is adhered to the sealing members of each of the at least two individual, sealed, blister packs to bind the blister packs together; and wherein the polymer film is a uni-axial shear polymer film, the connecting label being arranged and oriented such that a tear direction of the polymer film lies parallel to a line bisecting adjacent blister packs, and wherein said at least two individual, sealed blister packs are not connected together by said sealing members.

2. The packaging of claim 1 wherein the polymer film is a co-extruded, multilayer film.

3. The packaging of claim 1 wherein the uni-axial shear polymer film is a corona treated polyolefin film.

4. The packaging of claim 1, wherein a surface of the connecting label bears a printed image.

5. The packaging of claim 1, wherein the connecting label is adhered to the surface members of the blister packs with an adhesive.

6. The packaging of claim 1, wherein the blister packs have a planar upper surface and the connecting label is adhered to the planar upper surface of the at least two individual, sealed blister packs.

7. The packaging of claim 1, wherein the connecting label extends across three blister packs.

8. The packaging of claim 1 wherein the connecting label has a longest dimension of at least 70 mm.

9. The packaging of claim 2 wherein the uni-axial shear polymer film is a corona treated polyolefin film.

10. The packaging of claim 2, wherein a surface of the connecting label bears a printed image.

11. The packaging of claim 2, wherein the blister packs have a planar upper surface and the connecting label is adhered to the planar upper surface of the at least two individual, sealed blister packs.

12. The packaging of claim 2, wherein the connecting label extends across three blister packs.

13. A method of binding together at least two individual, sealed contact lens blister packs, each of the at least two individual, sealed blister packs comprising a plastic base member housing a single contact lens, and a sealing member; the method comprising a step of orientating a connecting label, comprising a uni-axial shear polymer film, such that the tear direction of the label lies parallel to a line connecting adjacent blister packs; and applying the label to the sealing members of two or more adjacent blister packs to bind the blister packs together.

14. The method of claim 13 wherein the uni-axial shear polymer film is a co-extruded, multilayer film.

15. The method of claim 13 wherein the uni-axial shear polymer film is a corona treated polyolefin film.

16. The method of claim 13, wherein a surface of the connecting label bears a printed image.

17. The method of claim 13, comprising the step of adhering the connecting label to the surface members of the two or more blister packs with an adhesive.

18. The method of claim 13, wherein the blister packs have a planar upper surface and the connecting label is applied to the planar upper surface of the at least two individual, sealed blister packs.

19. The method of claim 13, wherein the connecting label is applied across the sealing members of three blister packs.

20. The method of claim 13, wherein the connecting label has a longest dimension of at least 70 mm.

* * * * *